US006476835B1

(12) United States Patent
Philebrown et al.

(10) Patent No.: US 6,476,835 B1
(45) Date of Patent: Nov. 5, 2002

(54) COPLANAR THIN FILM PRINTHEAD

(75) Inventors: Peter Philebrown, Kanata (CA); Igor Kubelik, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/852,863

(22) Filed: May 10, 2001

(51) Int. Cl.[7] ..... B41J 2/415
(52) U.S. Cl. ..... 347/127; 347/123; 347/148
(58) Field of Search ..... 347/127, 123, 347/148

(56) References Cited

U.S. PATENT DOCUMENTS

| | | | | | |
|---|---|---|---|---|---|
| 4,155,093 | A | * | 5/1979 | Fotland et al. | 347/127 |
| 4,160,257 | A | | 7/1979 | Carrish | |
| 4,683,482 | A | * | 7/1987 | Inaba et al. | 347/127 |
| 4,697,196 | A | * | 9/1987 | Inaba et al. | 347/127 |
| 4,891,656 | A | | 1/1990 | Kubelik | |
| 4,985,716 | A | * | 1/1991 | Hosaka et al. | 347/123 |
| 5,027,136 | A | * | 6/1991 | Fotland et al. | 347/127 |
| 5,128,697 | A | * | 7/1992 | Bibl et al. | 347/148 |
| 5,202,705 | A | * | 4/1993 | Asano et al. | 347/127 |
| 5,325,118 | A | * | 6/1994 | Zybin et al. | |
| 5,351,020 | A | * | 9/1994 | Okamura et al. | |
| 5,477,251 | A | * | 12/1995 | Sugimura | 347/123 |

FOREIGN PATENT DOCUMENTS

| | | | |
|---|---|---|---|
| JP | 4-176666 | * | 6/1992 |
| JP | 9-216408 | * | 8/1997 |

OTHER PUBLICATIONS

Philebrown, Peter "Electron Beam Imaging Enhancement through the application of Thin Film Technology", IS&T's 49$^{th}$ *Annual Conference*, Nov. 1997.

* cited by examiner

*Primary Examiner*—Susan S. Y. Lee
(74) *Attorney, Agent, or Firm*—Fay, Sharpe, Fagan, Minnich & McKee, LLP

(57) ABSTRACT

A method and apparatus relating to a unique printhead configuration is disclosed. The printhead configuration is based on a coplanar arrangement of two sets of electrodes. The electrodes are electrically separated from each other by a dielectric layer, and together create a matrix of charge generating sites. Such a printhead has a very low internal capacitance and therefore is suitable for high speed and high resolution printing.

18 Claims, 5 Drawing Sheets

COPLANAR THIN FILM PRINTHEAD

FIELD OF THE INVENTION the invention relates to a printhead suitable for use with image forming systems and more particularly relates to a coplanar arrangement of electrodes within a single dielectric layer of the printhead.

BACKGROUND OF THE INVENTION many different printing technologies today utilized in image forming systems create and reproduce images in different ways. A process executed by some of these technologies (e.g.,Electron Beam Imaging) includes a step of charging a surface of an image-receiving member, such as a drum, with a latent charge image. The term image-receiving member include a drum, flat or curved surfaces, or a flexible belt. The image-receiving member can also be a liquid crystal or phosphor screen, or similar display panel in which latent charge image results in a visible image. Typically, an exterior surface of the image-receiving member includes a material, such as a dielectric include glass enamel, flame or plasma sprayed high-density aluminum oxides, and plastics, including polyamide, nylon, and other tough thermoplastic or thermoset resins, among other materials.

The image-receiving member, or drum, moves past an image forming device, such as printhead, which produces a stream of accelerated electrons as primary charge carriers. The electrons reach the drum, landing in the form of a latent charge image. The latent charge image then receives a developer material, to develop the image, and the image is then by press or electrostatic transfer applied and fused to a medium, such as a sheet of paper, to form a printed document.

The printhead most often includes a film having a multi-electrode structure that defines an array of charge generating sites. Each of the charge generating sites, when the electrodes are actuated, generates and directs toward the drum a stream of charge carriers, e.g., electrons, to form a pointwise accumulation of charge on the drum that constitutes the latent image. A representative printhead generally includes a first collection of drive electrodes, e.g., RF-line electrodes, oriented in a first direction across the printing process direction. A second collection of control electrodes, e.g., finger electrodes, oriented transversely to the drive electrodes, forms cross points or intersections with the drive electrodes constituting an array of charge generating sites at which charges originate. A dielectric layer couples to, and physically and electrically separates and insulates, the RF-line electrodes from the finger electrodes.

The printhead can also include a third electrode structure, often identified as a screen electrode. This screen electrode couples to the finger electrodes by an insulating structure, such as a spacer layer. The screen electrodes have a plurality of passages aligned with the charge generating sites, to allow the stream of charge carriers to pass through. The screen electrode can be a single conductive sheet having an aperture aligned over each charge generation site. Polarity of charge carriers passing through the passages, or apertures, depends on the voltage difference applied to the finger and screen electrodes. Polarity of particles accumulated on the drum to create latent image is determined by the voltage difference between the screen electrode and the drum surface. The charged particles of appropriate polarity are inhibited from passing through the aperture, depending upon the sign of their charge, so that the printhead emits either positive or negative charge carriers, depending on its electrode operating potentials.

A typical structure of the printhead is a vertical arrangement, wherein the RF-line electrodes, dielectric, finger electrodes, spacer, and screen electrode are gradually laminated each on top of the other. This vertical structure for a thin film printhead leads to a relatively high capacitance of the RF-lines. The large capacitance limits the usable charge generating frequency and consequently the speed of printing.

SUMMARY OF THE INVENTION

There exists in the art a need for a low capacitance printhead. The printhead of the present invention includes a first plurality of electrodes (e.g., RF-line electrodes), and a second plurality of electrodes (e.g., finger electrodes), arranged in a substantially common plane. A subsequently deposited dielectric layer seals the coplanar first plurality of electrodes and isolates electrical connections to the second plurality of electrodes.

Each of the plurality of electrodes has a different arrangement, according to a further aspect of the present invention. One such arrangement includes electrodes with an elongate section having electrode peninsulas extending outwardly therefrom. The other plurality of electrodes includes individual electrodes surrounding each of the extending electrode peninsulas. A single dielectric layer then seals the substantially coplanar electrode layers.

The single dielectric layer, according to one aspect of the present invention, can be made of two or more layers, each layer being formed of a different material.

A method of making a printhead according to the teachings of the present invention includes applying a metal coating to a substrate material to form electrodes. An etching process forms two sets of substantially coplanar electrodes from the substrate coating material. A dielectric composition then covers each of the two sets of electrode patterns. The dielectric composition is then selectively perforated and a second metal layer is deposited to form electrode interconnections.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

The present invention generally relates to a printhead mounted within an image forming system. A characteristic of the printhead is that there exist two or more distinct coplanar electrode layers, and a dielectric layer, within the printhead. Typically, the printhead includes a set of RF-line electrodes and a set of finger electrodes manufactured from a single metallic layer, and subsequently sealed by a common, relatively thin, dielectric layer. This geometry provides for a printhead with a relatively lower overall capacitance suitable for high resolution and fast printing.

FIGS. 1 through 7 illustrate the coplanar thin film printhead according to the teachings of the present invention. Although the present invention will be described with reference to the example embodiments illustrated in the figures, it should be understood that many alternative forms can embody present invention. One of ordinary skill in the art will additionally appreciate different ways to alter the parameters of the embodiments disclosed, such as the size, shape, or type of elements or materials, in a manner still in keeping with the spirit and scope of the present invention.

The image forming system is illustrated solely for the purpose of providing a general structure in which the present invention can reside. It is wholly anticipated that other systems or charge transfer apparati can be utilized in combination with different embodiments of the present invention.

Figure 1:
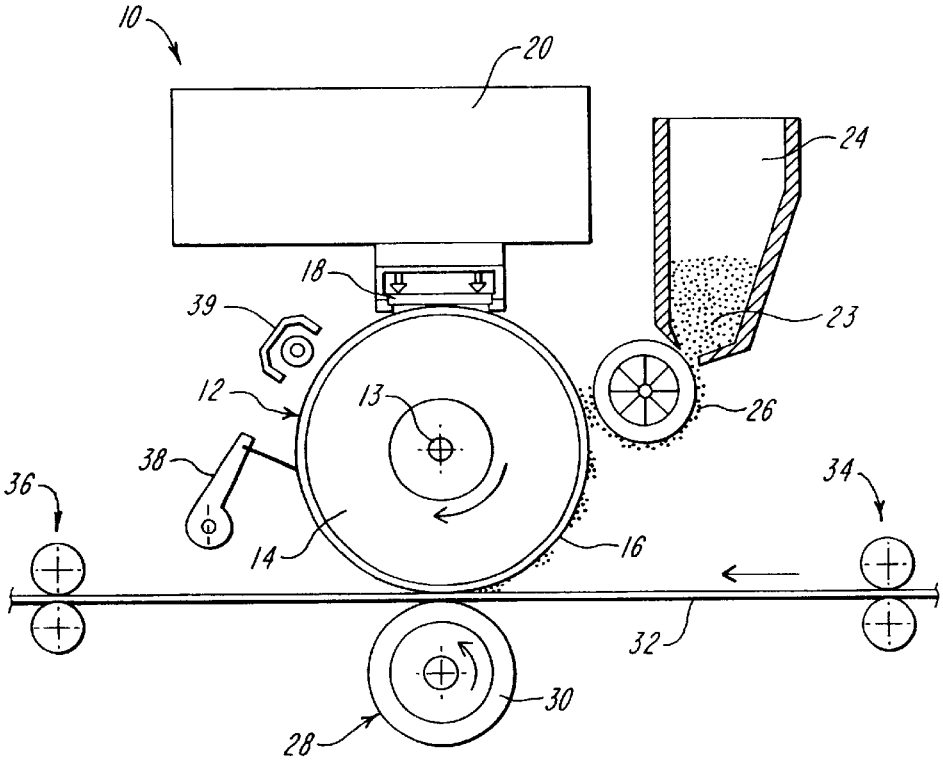
FIG. 1 is a diagrammatic illustration of an image forming system suitable for use with the printhead of the present invention.

FIG. 1 schematically illustrates an image forming system 10 of the electron beam imaging (EBI) variety, having an image-receiving member, such as a drum 12 that mounts for rotation about an axis 13. The drum 12 incorporates an electrically conductive core 14. coated with a dielectric layer 16. The dielectric layer 16 receives a charge image from a printhead 18. A controller 20 drives the printhead. I as desired. Charge generating sites within the printhead 18 generate a charged image and transfer the image to the dielectric layer 16 on the outer surface of the drum 12 as the drum 12 rotates in the direction of the arrow shown. The drum 12 continues to rotate and the entire drum surface including the charged portion of the dielectric layer 16 comes into contact with toner particles 23; supplied from a hopper 24 through a feeder 26. The toner particles 23 electrostatically adhere to the charged image on the dielectric layer 16 to form a toner image. The rotating. drum 12 then carries the toner image towards a nip formed with a pressure roller 28. The pressure roller 2g has an outer layer 30 positioned in the path of a receptor, such as a paper sheet 32. The paper sheet 32 enters between a pair of feed rollers 34. The pressure in the nip is sufficient to cause the toner particles 23 to transfer to the paper sheet 32, permanently affixing the toner particles 23 thereto. The paper sheet 32 continues through and exits between a pair of output rollers 36. After passing through the nip between the drum 12 and the pressure roller 28, a scraper blade assembly 38 removes any toner particles 23 that may remain on the dielectric layer 16. A charge eraser 39 positioned between the scrapper blade assembly 38 and the printhead 18 removes any residual charge remaining on the dielectric layer 16 surface.

A printhead configuration known to those skilled in the art is most common in EBI printing technologies. The printhead includes a first electrode layer having a plurality of electrodes, called RF-line electrodes, sealed and electrically isolated from a second electrode layer by at least one dielectric layer. The second electrode layer also comprises a plurality of electrodes, known as finger electrodes, which cross the plurality of RF electrodes creating a matrix of plasma generating sites from where the charge, used for imaging, is emitted.

Figure 2:
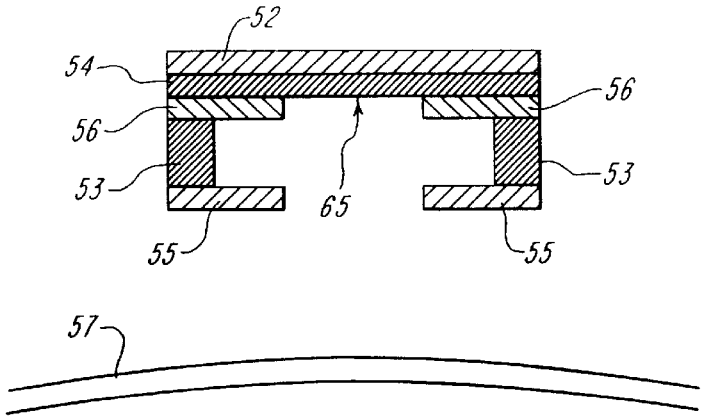
FIG. 2 (PRIOR ART)
FIG. 2 is a diagrammatic cross-sectional view of a collection of charge generating sites in a printhead.

The illustration of FIG. 2 generally illustrates a portion of the conventional printhead configuration. The printhead includes a first electrode layer, e.g., the RF-line electrode layer 52, covered and sealed by a dielectric layer 54. On the opposite side of the dielectric layer 54 is a second electrode layer, e.g., the finger electrode layer 56. The printhead can also include a spacer layer 53 supporting a screen electrode 55. The screen electrode 55 aids in the proper alignment of the emitted charge carriers as is understood by one of ordinary skill in the art. The printhead is oriented with respect to a drum 57, similar to the drum 12 of FIG. 1, for generating and transferring charge from a charge generating site 65 to the drum 12 to form the latent image.

Figure 3:
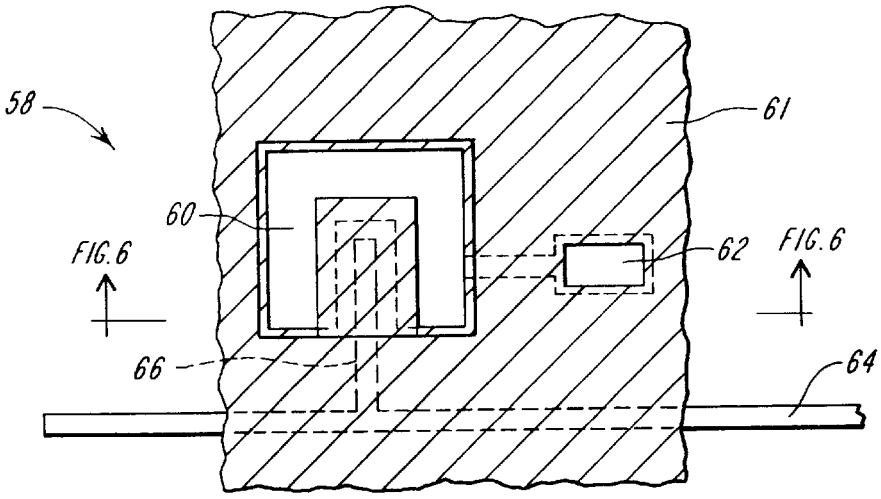
FIG. 3 is a schematic illustration of an electrode configuration of the printhead of the present invention.

FIG. 3 illustrates a possible electrode configuration 58 according to the teachings of the present invention. A finger electrode 60 extends in a single plane having a generally U-shape configuration, which surrounds the RF electrode 66. The finger electrode 60 includes an extension that couples to a contact 62 in approximately the same plane. The RF electrode 66 in connection with the RF-line 64, form the RF-line electrode, which generally extends across the electrode configuration 58 to contribute to the formation of a sufficient number of charge generating sites.

Those of ordinary skill in the art will readily recognize that the RF-electrodes 66 are shown as peninsulas extending from the RF-lines 64, but the RF-electrodes 66 can have any suitable shape, as long as they are in mutual proximity with the finger electrodes 60 in a manner sufficient for charge generation to occur. RF-line 64 is in substantially the same plane as the finger electrode 60, and can have various different forms as well, such as curves, waves, zigzags, peaks and valleys, or other suitable patterns or shapes. The finger electrode 60 can also exist in other forms or shapes, again, as long as there is sufficient proximity to the RF-electrode 66 to result in the desired charge generating capabilities.

The illustrated coplanar electrode configuration is partially covered by a dielectric layer 61. The dielectric layer 61 serves to electrically separate and insulate the coplanar finger electrode 60 from the coplanar RF-electrode 66, as well as the RF-line 64, and the contact 62. While the RF-electrodes 66 and RF-lines 64 are fully sealed by the dielectric layer 61, the finger electrodes are only partially covered to allow for an electrical contact with generated charged particles and for finger electrode interconnections. A cutaway illustration of the electrode configuration 58 is further illustrated in FIG. 5.

The dielectric layer, or dielectric composition, as disclosed herein includes a number of different structures and materials. The dielectric, for example, can be a single layer of a single material type, or can include a plurality of layers of either the same or different dielectric materials. A plethora of compositions can form the dielectric. Some possible materials include silicon dioxide, aluminum oxide, magnesium oxide, silicon nitride, and boron nitride.

Figure 4:
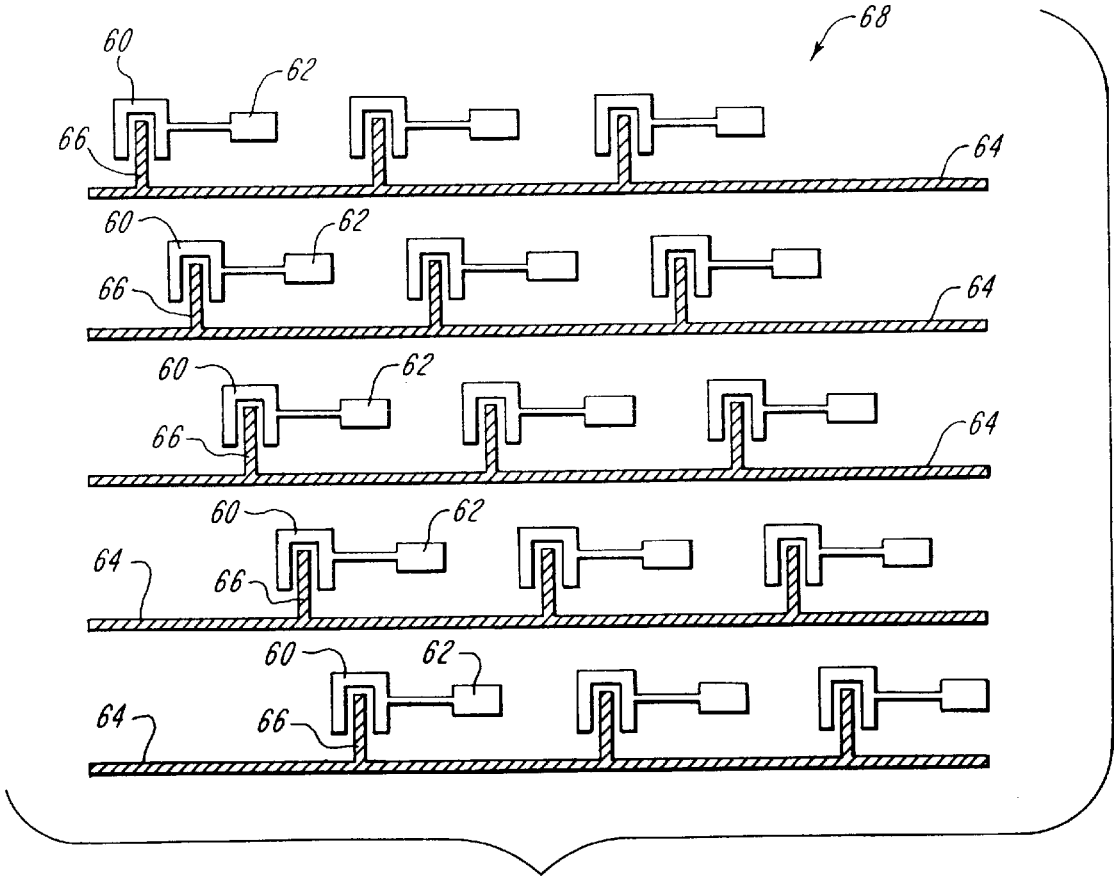
FIG. 4 is a schematic illustration of an arrangement of electrode configurations according to the teachings of the present invention.

FIG. 4 illustrates a section of a thin film element 68 of the printhead 18 according to the teachings of the present invention. As illustrated, the series of RF-lines 64 extend in parallel fashion relative to one another across the film segment 68. Each RF-line 64 interconnects a set of periodically placed coplanar RF-electrodes 66 surrounded by generally U-shaped finger electrodes. The coplanar electrodes (RF-electrodes 66, finger electrodes 60, as well as RF-lines 64) are covered by a dielectric layer (not shown) provided with openings in registration with finger electrodes 60 and contacts 62. The finger electrodes 60 are connected into fingers by metal strips deposited across the dielectric openings (not shown).

Each arrangement of finger electrode 60 surrounding each RF-electrode 66 creates a charge generating site for depositing electric charges on charge receiving elements, such as the dielectric drums 12 (as show in FIGS. 1 and 2). The finger electrode 60 does not need to surround each RF-electrode 66, but merely needs to be sufficiently proximal to the RF-electrode 66 to create the charge generating sites.

Figure 5:
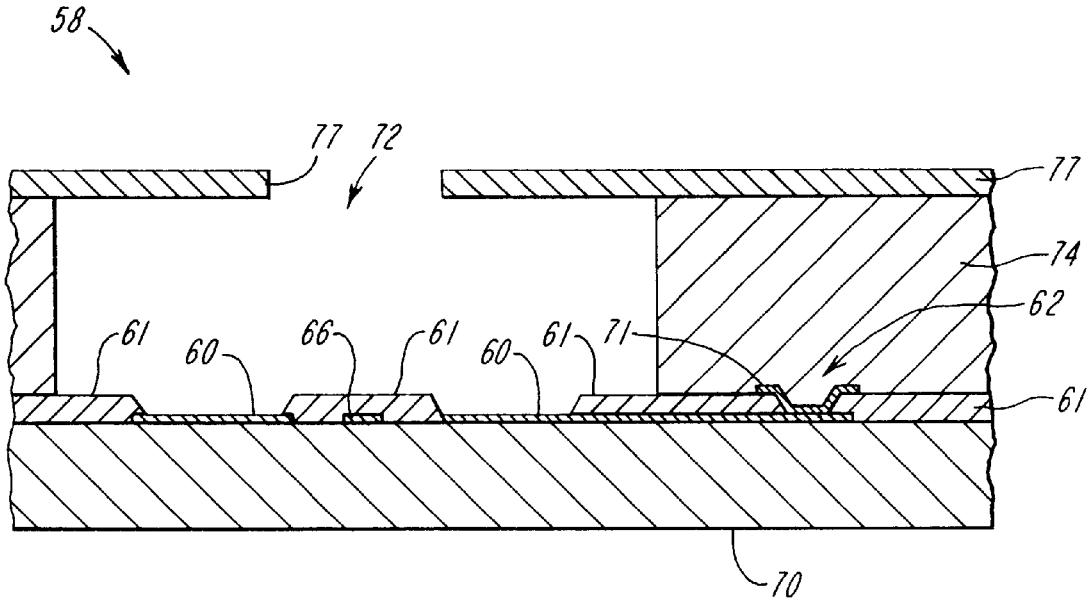
FIG. 5 is a partial cross-sectional view of the electrode configuration of FIG. 3.
Figure 6A:
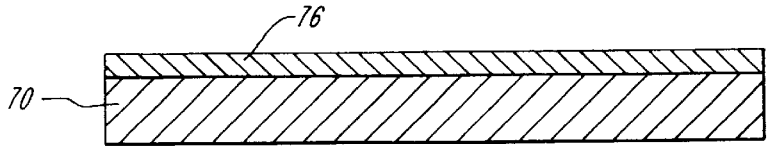
FIGS. 6A–6F illustrate the steps for manufacturing the electrode configuration of the present invention.
Figure 6B:
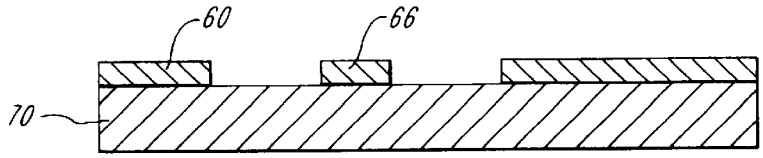
Figure 6C:
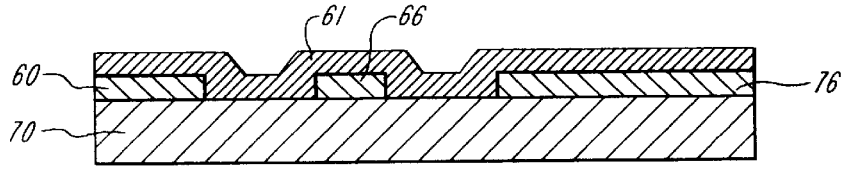
Figure 6D:
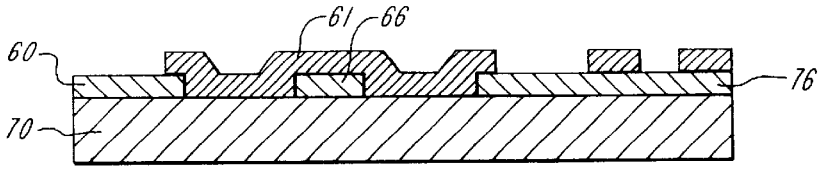
Figure 6E:
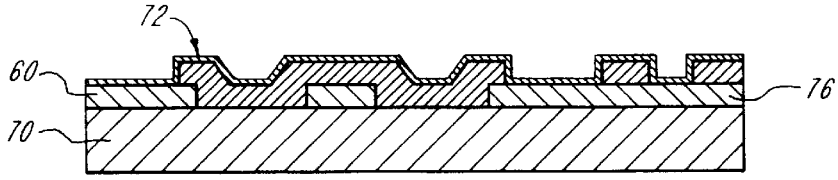
Figure 6F:
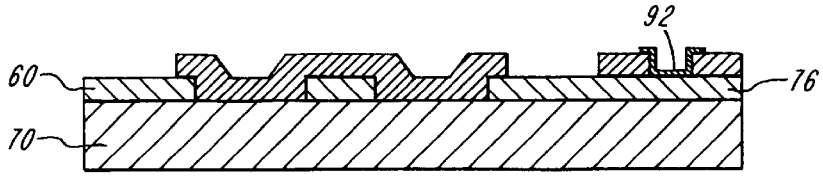

FIG. 5 is a cross-sectional view of the electrodes configuration 58 of FIG. 3. A substrate 70 forms the base of the configuration 58. The finger electrode 60 and the RF-electrodes 66 lie atop the substrate 70. The dielectric layer 61 extends across the top of the substrate 70, the finger electrode 60, the RF-line 64 (not shown), and the RF-electrode 66 in a predetermined fashion such that the dielectric layer 61 electrically insulates the finger electrode 60 and the RF-electrode 66 from each other. The finger connection is shown in further detail as a metal strip 71 extending from atop the dielectric layer 61 to make electrical contact with the extension of the finger electrode 60 through the finger contact pad 62. A spacer element 74 supports a screen 77. The screen contains a screen hole 72, therethrough.

A stepwise illustration of one suitable method for manufacturing of the electrode configuration 58 according to the present invention, is shown in FIGS. 6A–6F. A substrate 70 is first coated with a metal layer 76 suitable for forming both the finger and RF electrode layers, FIG. 6A. The metal layer 76 is patterned by a standard photo-imaging and etching process to form two sets of coplanar electrodes (finger electrodes 60 and RF-electrodes 66), FIG. 6B. Such photo-imaging and etching processes are well known the art and are not described further herein. A layer of dielectric material 61 covers the finger electrodes 60 the RF-electrodes 66, and the RF-line 64 (not shown) through use of well known thin film application technologies, such as, e.g., sputtering, evaporation, and the like, FIG. 6C. A dry or wet etching process perforates, or removes portions of, the dielectric layer 61, to clear areas used for an interconnection of finger electrodes 60 and to enable finger electrode electrical contact 62 with emitted charged particles, FIG. 6D. The perforations made through the dielectric layer 61 extend to the electrode layer. An additional metal layer 71 is applied to cover the entire structure, FIG. 6E. A further etching process selectively removes portions of the additional metal layer 71 to form the finger electrode interconnections 92, FIG. 6F.

Figure 7:
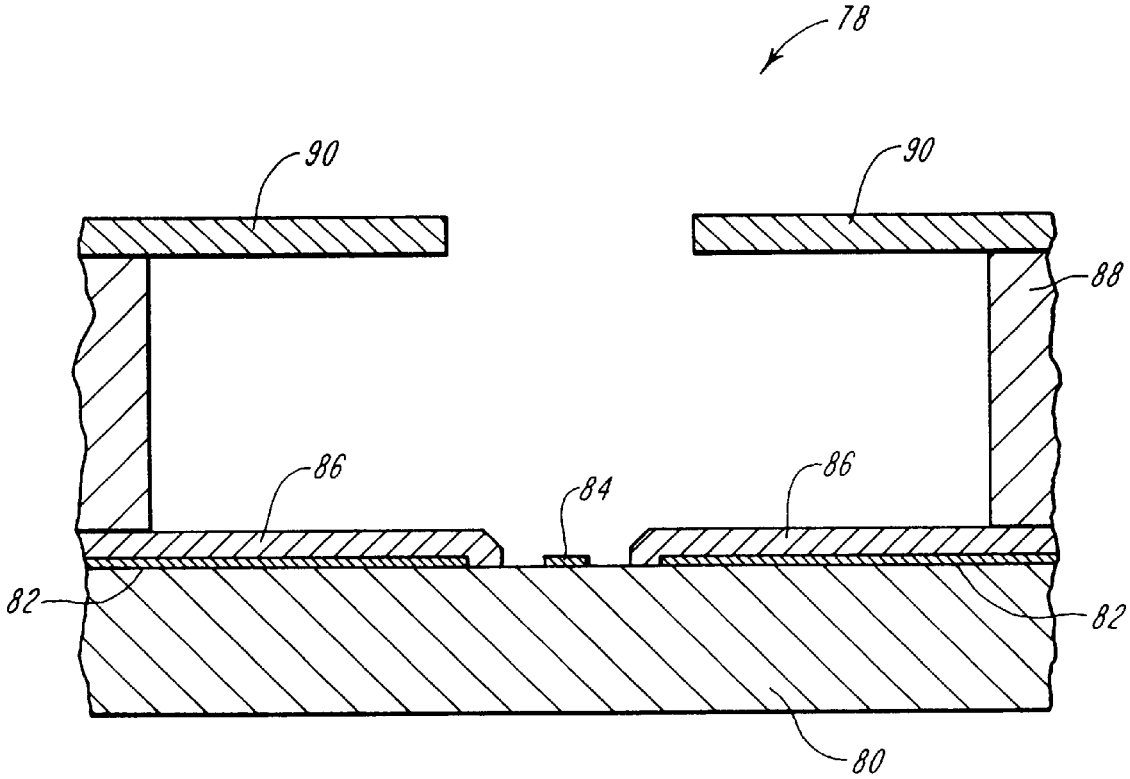
FIG. 7 is a schematic illustration of an alternate electrode configuration of the printhead of the present invention.

FIG. 7 illustrates an alternate embodiment of the printhead of the present invention. The illustrated electrode configuration 78 includes a substrate 80 that forms a base layer. A finger electrode 82 and an RF-electrode 84 are arranged on the substrate 80 similarly to that shown in FIG. 5. A dielectric layer 86 fully seals the finger electrode 82, while the RF-electrode 84 remains exposed. The dielectric layer 86 extends sufficiently beyond an edge of the finger electrode 82 to serve as an electric insulator between the finger electrode 82 and the RF-electrode 84. A spacer 88 provides support for a screen electrode 90.

The coplanar design of the present invention placing the electrode layers in substantially the same plane along with the dielectric layer, as disclosed herein, has several advantages. The distance required between the finger and RF-electrodes does not rely upon a thickness of a deposited dielectric layer. The proper distance, instead, is achieved by lateral placement of the electrodes within substantially the same plane, rather than in an axial fashion. Coplanar printheads have a reduced capacitance and are suitable for high resolution fast printing. Overall, the cost of manufacture is reduced due to the lesser amount of printhead manufacturing steps and lesser amounts of dielectric material required.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. In an image forming system, a printhead comprising:

a first plurality of electrodes arranged in a substantially common plane;

a second plurality of electrodes arranged to be substantially coplanar with said first plurality of electrodes; and a dielectric composition disposed at least between at least a portion of said first plurality of electrodes and said second plurality of electrodes;

wherein one of said first plurality of electrodes and said second plurality of electrodes comprises RF-electrodes.

2. The printhead according to claim 1, wherein one of said first plurality of electrodes and said second plurality of electrodes comprises finger electrodes.

3. The printhead according to claim 1, wherein said first plurality of electrodes comprises an elongate section having electrodes extending therefrom.

4. The printhead according to claim 3, wherein said extending electrodes are generally in the shape of peninsulas.

5. The printhead according to claim 3, wherein said second plurality of electrodes comprises individual electrodes proximal to each of said extending electrodes.

6. In an image forming system, a printhead comprising:

a first plurality of electrodes arranged in a substantially common plane, a second plurality of electrodes arranged to be substantially coplanar with said first plurality of electrodes; and a dielectric composition disposed at least between at least a portion of said first plurality of electrodes and said second plurality of electrodes, wherein said first plurality of electrodes comprises an elongate section having electrodes extending generally in the shape of peninsulas and said second plurality of electrodes comprises individual electrodes substantially surrounding each of said extending electrodes.

7. In an image forming system, a printhead comprising:

a first plurality of electrodes arranged in a substantially-common plane;

a second plurality of electrodes arranged to be substantially coplanar with said first plurality of electrodes; and a dielectric composition disposed at least between at least a portion of said first plurality of electrodes and said second plurality of electrodes, said dielectric composition including a single dielectric layer disposed over said electrodes for sealing said first plurality and said second plurality of electrodes.

8. In an image forming system a printhead comprising:

a first plurality of electrodes arranged in a substantially common plane;

a second plurality of electrodes arranged to be substantially coplanar with said first plurality of electrodes; and a dielectric composition disposed at least between at least a portion of said first plurality of electrodes and said second plurality of electrodes, wherein said dielectric composition includes one or more dielectric layers, each layer being formed of a different dielectric material.

9. A method of forming an electron beam imaging printhead, the method comprising:

forming a first plurality of electrodes and a plurality of RF electrodes in a substantially common plane; and applying a dielectric composition between said first plurality of electrodes and said plurality of RF electrodes.

10. A method of forming a printhead, comprising:

coating a substrate with a metal suitable for forming electrodes;

forming two distinct sets of electrodes in said coated substrate in the same plane; and covering said two sets of electrodes with a dielectric composition.

11. The method according to claim 10, further comprising selectively perforating said dielectric composition.

12. The method according to claim 11, further comprising selectively coating said dielectric composition with a metal layer.

13. The method according to claim 12, further comprising selectively forming electrode interconnections from said metal layer.

14. In an image forming system, a printhead comprising:

a first plurality of electrodes arranged in a substantially common plane;

a second plurality of electrodes substantially coplanar with said first plurality of electrodes; and a dielectric composition covering said first plurality of electrodes and said second plurality of electrodes, such that said dielectric composition seals gaps existing between said first plurality of electrodes and said second plurality of electrodes.

15. The image forming system according to claim 14, wherein each of said first plurality of electrodes is an RF-electrode.

16. The image forming system according to claim 14, wherein each of said second plurality of electrodes is a finger electrode.

17. The image forming system according to claim 14, wherein said first plurality of electrodes comprises peninsulas individually surrounded on three sides by said second plurality of electrodes.

18. The image forming system according to claim 14, wherein said dielectric composition comprises two layers of differing dielectric materials.

* * * * *